US010294731B2

(12) United States Patent
Eidem et al.

(10) Patent No.: US 10,294,731 B2
(45) Date of Patent: May 21, 2019

(54) DRILL PIPE COMPLETION DEVICE

(71) Applicant: STATOIL PETROLEUM AS, Stavanger (NO)

(72) Inventors: Morten Eidem, Trondheim (NO); Stein Børre Torp, Stavanger (NO); Torgeir Wenn, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 155 days.

(21) Appl. No.: 15/424,545

(22) Filed: Feb. 3, 2017

(65) Prior Publication Data

US 2017/0218708 A1 Aug. 3, 2017

(30) Foreign Application Priority Data

Feb. 3, 2016 (GB) ..... 1601967.1

(51) Int. Cl.

| | |
|---|---|
| ***E21B 17/05*** | (2006.01) |
| ***E21B 17/10*** | (2006.01) |
| ***E21B 34/10*** | (2006.01) |
| *E21B 34/00* | (2006.01) |

(52) U.S. Cl.

CPC ..... *E21B 17/05* (2013.01); *E21B 17/1057* (2013.01); *E21B 34/10* (2013.01); *E21B 2034/007* (2013.01)

(58) Field of Classification Search

CPC ..... E21B 17/05; E21B 17/1057

See application file for complete search history.

(56) References Cited

U.S. PATENT DOCUMENTS

| | | | | |
|---|---|---|---|---|
| 2003/0075321 | A1* | 4/2003 | Hall | E21B 4/18 166/241.1 |
| 2005/0098353 | A1* | 5/2005 | Maxwell | E21B 17/1014 175/57 |
| 2008/0236841 | A1* | 10/2008 | Howlett | E21B 17/05 166/381 |
| 2016/0326812 | A1* | 11/2016 | Hanton | E21B 17/05 |
| 2017/0044843 | A1* | 2/2017 | Hanton | E21B 17/05 |

FOREIGN PATENT DOCUMENTS

| | | | |
|---|---|---|---|
| GB | 2 451 022 | A | 1/2009 |
| WO | WO 2015/104389 | A1 | 7/2015 |
| WO | WO 2015/161993 | A2 | 10/2015 |

* cited by examiner

*Primary Examiner* — Giovanna C Wright

(74) *Attorney, Agent, or Firm* — Birch, Stewart, Kolasch & Birch, LLP

(57) ABSTRACT

A method of completing a well which has a longitudinal axis along a direction with a horizontal component, the method comprising rotating a first string and moving the first string into the well along the longitudinal axis of the well, providing a swivel joint rotatably connecting the first string to a second string, moving the second string along the longitudinal axis of the well into the well, wherein the second string comprises completion equipment, moving the completion equipment into the well along the longitudinal axis of the well.

11 Claims, 4 Drawing Sheets

DRILL PIPE COMPLETION DEVICE

BACKGROUND

This invention relates to well completion tools and methods for completing a well.

A well completion process typically takes place after the well has been drilled and prepares the well for production or injection. The well may be completed by placing a liner or a casing inside the well to support the structural integrity of the well and such a liner or casing is cemented against the formation. The use of a cemented liner or casing can be avoided in open-hole completion. The production zone may be left bare in open-hole completion, but usually sand control is required by way of a sand screen or slotted liner to avoid inflow of sand into the production tubing. A gravel pack may be used to prevent sand from entering the well. A pump such as an electrical submersible pump may also be placed in the production zone to create artificial lift if the well pressure is not sufficiently high for production.

STATEMENT OF INVENTION

According to a first aspect of the invention, there is provided a method of completing a well which has a longitudinal axis along a direction with a horizontal component, the method comprising: rotating a first string and moving the first string into the I well along the longitudinal axis of the well, providing a swivel joint rotatably connecting the first string to a second string, moving the second string along the longitudinal axis of the well into the well, wherein the second string comprises completion equipment, moving the completion equipment into the well along the longitudinal axis of the well.

The second string may be rotationally at rest during said moving the second string. The method may further comprise controlling fluid circulation with a ball operated sleeve provided at the swivel joint and/or locking the swivel joint with a locking means. The swivel joint may comprise a ball bearing or a thrust washer.

According to a second aspect of the invention, there is provided a well completion assembly comprising: a first string arranged to rotatably progress through the well, a second string comprising a completion equipment, a swivel joint rotatably connected to the first string and the second string. The swivel joint may comprise a ball bearing or a thrust washer.

The well assembly may further comprise a ball operate sleeve. The ball operated sleeve may comprise locking means for locking the rotation of the swivel joint and the locking means may comprise matching splined surfaces for locking the swivel joint. The ball operated sleeve may further comprise means for controlling fluid flow in the well.

Additional preferred features are set out in the dependent claims.

DRAWINGS

Some embodiments of the invention will now be described by way of example only and with reference to the accompanying drawings, in which.

DESCRIPTION

Figure 1:
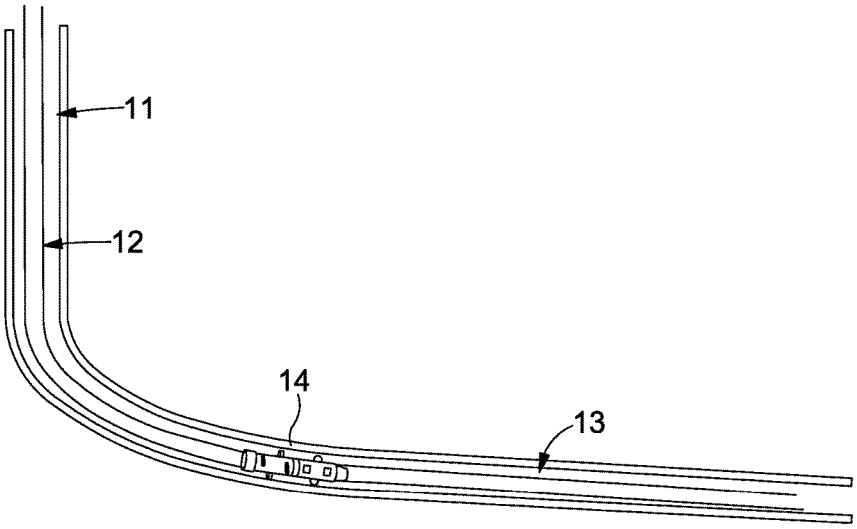
FIG. 1 illustrates schematically a well.

A liner or well tools can be placed into the well using a completion string. The completion string can, in turn, be driven by a drill string. The completion string may also comprise or consist of completion tools. The tools are driven into the well by the force applied onto the completion string by the drill string. The downward force acting on the completion string is the weight of the drill string minus friction forces from the contact between the drill string and the casing wall. Each time a new length of drill pipe is added to the drill string, the downward movement is stopped in order to make up the threaded connection. When the downward movement of the pipe is stopped and subsequently started again, the initial friction force will be a kinetic friction force instead of a static friction force. Static friction forces are generally much higher than kinetic friction forces. Extra force is required to overcome the static friction before the downward movement continues. This extra force will induce high compressional forces and/or torque in the drill string and may lead to uncontrolled movement of the completion string once the static friction is overcome. Once rotation of the entire string starts again, the drill string will experience kinetic friction instead of static friction and the downward movement will take place more smoothly. The static friction force can make it impossible to continue downward movement if it is too large, or make the drill string buckle due to the compressive force or torque. The threshold at which the string buckles limits the length of the well which can be completed. The length of the well is more limited in horizontal wells when compared to vertical wells because of the additional friction between the string or the tool and the sides of the well due to gravity acting on the string and the tool and forcing the string and tool against the side of the well.

One of the main restrictions to moving the completion string to a required depth in an open-hole well is buckling of the string which is used to drive the completion string through a horizontal well, or a horizontal section of a well, or a section of a well which has a substantial horizontal component. The inventors have realised that this restriction is mainly caused by the fact that the drillpipe or drillstring and completion string normally is preferably not rotated during completion due to torque limitations on the completion components. A rotation of the completion components against the walls of the well would damage the completion components. If rotation is avoided, the assembly of the drillpipe, completion string and completion components needs to be driven linearly through the well. The linear movement is limited by the maximum force which can be applied to the completion string and drill string without the completion string and/or drill string buckling. The friction between the wall of the well and the drillstring in a horizontal well reduces the force transferred from the drillstring onto the completion components because energy will be lost due to the friction, but increasing the force would also increase the risk of the pipe buckling. The risk of buckling of the pipe makes it both difficult to get sufficient weight down to the top of the completion string and to have control of how much weight is actually applied.

Herein disclosed is an assembly in which a swivel joint is provided between the drill pipe, or other string extending to the surface, and the completion string. The swivel joint allows relative rotation of the drill pipe and completion string. In this arrangement, the drill pipe used to drive the completion string can be rotated while the completion string does not rotate, during progression of the combined assembly into the well. The rotation of the drill string will allow the weight applied on the drill string at the surface to travel down to the top of the completion string with reduced friction in axial direction, both avoiding buckling and allowing significantly more control of the weight applied. The completion components are not rotated because they are attached to the completion string which does not rotate.

FIG. 1 illustrates schematically a well 11 which has a portion with a significant horizontal orientation. A drill string 12 is provided which in use rotates and moves along the axial directions. A completion string 13 is provided which in use moves along the axial direction without rotation. The drill string and completion string are connected by a swivel joint 14.

Figure 2A:
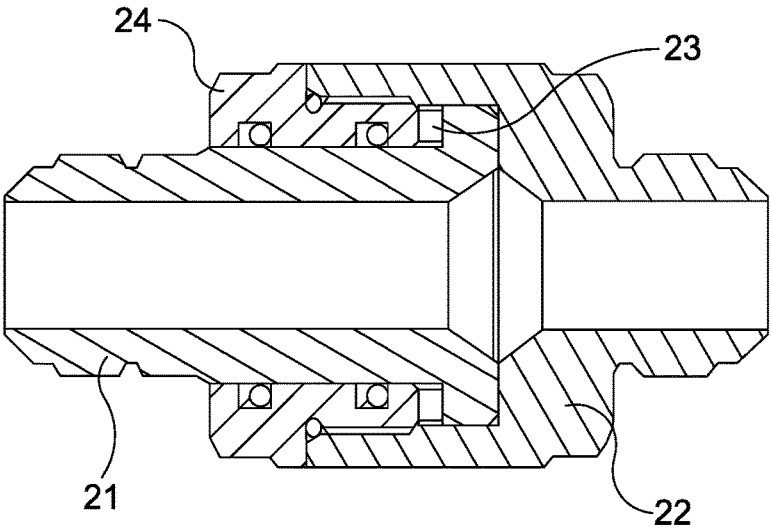
FIGS. 2A and 2B illustrate swivel joints.

A first embodiment of a swivel joint is illustrated in FIG. 2A. This joint connects a first side 21 to a second side 22. The first side can be connected to the drill string while the second side can be connected to the completion string. A thrust washer 23 is provided which provides an interface between the first side and the second side. A closing ring 24 keeps the thrust washer in place.

Figure 2B:
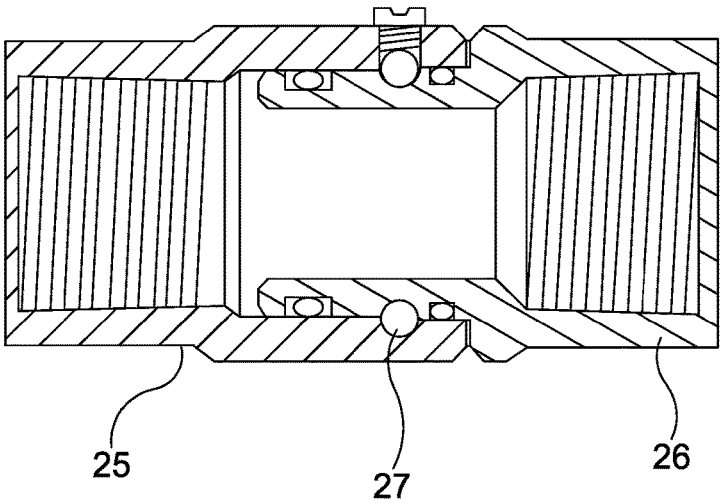

A second embodiment of a swivel joint is illustrated in FIG. 2B. A first part 25 is connected to a second part 26 by way of a ball bearing with balls 27. The ball bearing provides a low friction swivel coupling between the first and second parts.

The low friction in the joint of FIG. 2A or 2B in combination with friction of the completion string against the walls of the well avoids rotation of the completion sting while the drill string rotates. However, the inventors have appreciated that additional subs may be used to stimulate the rotation of the drill string, while avoiding rotation of the completion string.

In addition to the swivel joint, the assembly may have a pusher sub provided on the drill string, or other string, before the swivel joint. The pusher sub is arranged such that a rotational motion of the drill string causes the drill string to be pulled into the well. The pusher sub will cause movement in the longitudinal direction of the well. The pulling function of the pusher sub at the end of the drill string which is located at the furthest position in the well will reduce the compressive forces on the drill string. The pusher sub therefore will both reduce compressive forces and advance the drill string onto which it is attached. The pulling force will also reduce the amount of force which needs to be applied to the end of the string closest to the surface. Means for advancing the sub into the well on rotation of the sub are provided.

The function of the pusher sub can be carried out by a plurality of rotating wheels which project outwards from the pusher sub. The rotational axis of the wheels is fixed with respect to the pusher sub. Part of the wheels projects outside the sub such that, when the sub is inside the well the wheels are in contact with the formation or the well liner. The wheels are at an angle between 0 and 90 degrees with respect to the plane which is perpendicular to the longitudinal axis of the drill string and pusher sub. The angle of the wheels causes the rotational motion of the string and pusher sub to be translated into axial direction, similar to the function of a thread of a screw.

The wheels may be retractable such that they can be activated by extending the wheels outwards and de-activated by retracting them into the sub. Activation and deactivation of the wheels may be controlled by drop-ball devices or more advanced control systems. The retraction mechanism may be based on a hydraulic or mechanical drive mechanism. The angle of the wheels may be variable to control the relation between rotation speed and forward force and speed. A small angle between the plane perpendicular to the axis and the wheels will result is a slower progression but larger pulling forces when compared with a large angle. The angle may be set up manually before running the sub into the well or may be controlled remotely during operation. The angular control mechanism is arranged to rotate the axis of the wheels. The wheels may be provided symmetrically around the sub such that the forces acting on the wheels In addition to the swivel joint and the pusher sub, an anti-rotation sub can be provided on the completion string. The anti-rotation sub is arranged to prevent or reduce friction of the completion string. The pusher sub and the anti-rotation sub may be directly coupled to the swivel joint. The function of avoiding rotation may be implemented by means for preventing rotation such as a plurality of wheels which are aligned with the longitudinal direction of the sub such that movement in the longitudinal direction of the well bore is enabled, while rotation with respect to the well bore is prevented. The wheels may be retractable. The wheels can be activated such that they are in contact with the inside wall of the well. The wheels may be provided symmetrically around the sub to distribute the forces acting on the wheels evenly on the sub.

The wheels on the pusher sub and the anti-rotation sub may be made of materials which have sufficient friction against the casing wall without damaging the surface. By having a down-hole pushing device in the completion running string, it is possible to control the downward force and speed applied to the completion string during running. By combining a rotation driven pusher with both a swivel sub and an anti-rotation sub the completion string can be pushed into place in a controlled manner without being exposed to torque. It is an option to use a swivel sub in combination with only one of the anti-rotation sub and pusher sub.

Figure 3:
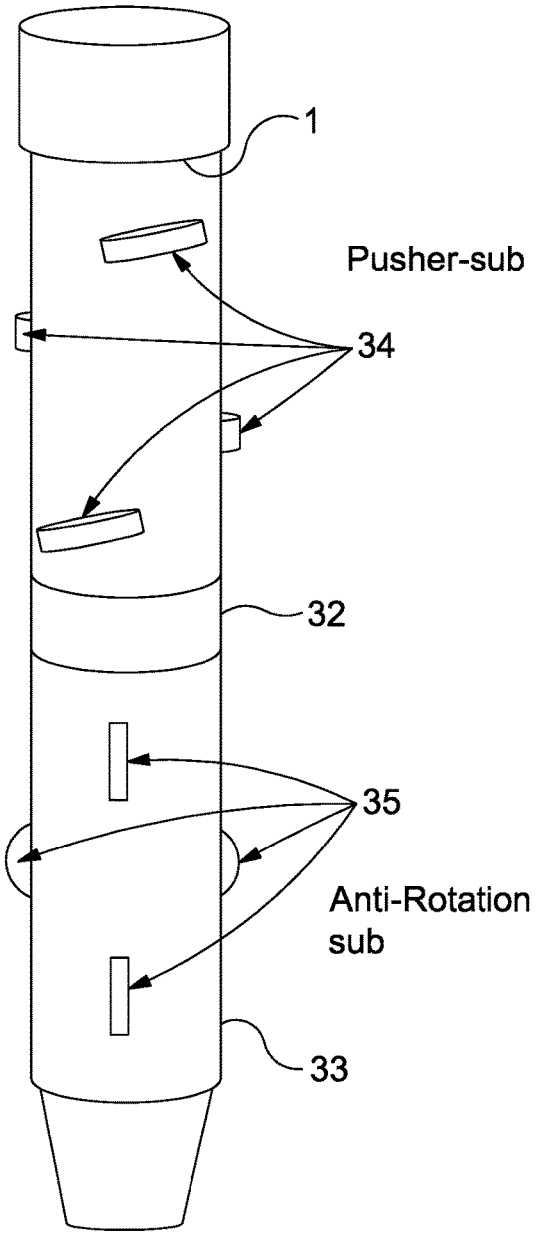
FIG. 3 illustrates a pusher sub.

FIG. 3 illustrates a combination of a pusher sub (31), a swivel sub (32) and an anti-rotation sub (33) which are connected to each other in a sequence. The pusher sub has wheels (34) which are arranged at an angle between 0 and 90 degrees with respect to the plane perpendicular to the longitudinal axis of the sub. The angle with respect to the plane perpendicular to the longitudinal axis of the sub is preferably between 0 and 20 degrees, more specifically between 0 and 10 degrees. Alternatively, the angle may be between 0 and 5 degrees, or between 5 and 10 degrees. The inventors have appreciated that an angle between 2 and 5 degrees, plus or minus one degree, is particularly advantageous for the rotation speed and progression used in a completion well. The pusher sub can also be rotated in the opposite direction such that it drives the string out of the well instead of into the well.

The anti-rotation sub has wheels (35) which are arranged in the same direction as the longitudinal axis of the sub.

The swivel joint can furthermore be equipped with a ball operated sleeve which can be activated for the joint to act as a circulation sub, to regain circulation down through the completion string and act as a seal over the swivel joint, or to regain rotation functionality of the completion string. The sleeve can be moved by dropping a ball down the tubing which is received by a ball valve seat. When fluid is pumped down the tubing, the pressure will increase due to the ball valve being closed and the pressure will move the sleeve with respect to the joint. Movement of the sleeve with respect to the joint may open or close ports by aligning or misaligning openings on the sleeve and the joint.

The ball valve and ball operated sleeve can also be used during gravel pack operations when fluid flow needs to be redirected outside a screen of the gravel pack assembly when gravel is put in place. The gravel pack assembly is connected to the completion string or forms the completion string, and the swivel joint with ball operated sleeve provides both the function of protecting the gravel pack assembly and controlling the fluid flow towards the gravel pack assembly.

Alternatively, the sleeve may be provided with splines which extend along the axial direction. Matching splines may be provided on a surface of the joint adjacent to the sleeve. When the splines on the sleeve and the joint are engaged with each other, the sleeve and joint cannot rotate with respect to each other. This rotational locking mechanism can be used to lock the swivel joint and disable the swivel function. This mechanism is one example of locking means.

A ball valve may also be used to lock and unlock the swivel joint. The ball valve provides a mechanical means for communicating with the downhole swivel joint or associated devices. Besides mechanical means, electronic means could be used for communicating with the swivel joint and for locking or unlocking the swivel joint. Other means for controlling or communicating with the swivel joint and/or the pusher sub and/or the anti-rotation sub may also be provided, such as hydraulic means, acoustic or electromagnetic means. An advantage of using acoustic or electromagnetic means is that a signal can be transmitted through the well or the formation without requiring a cable.

Figure 4:
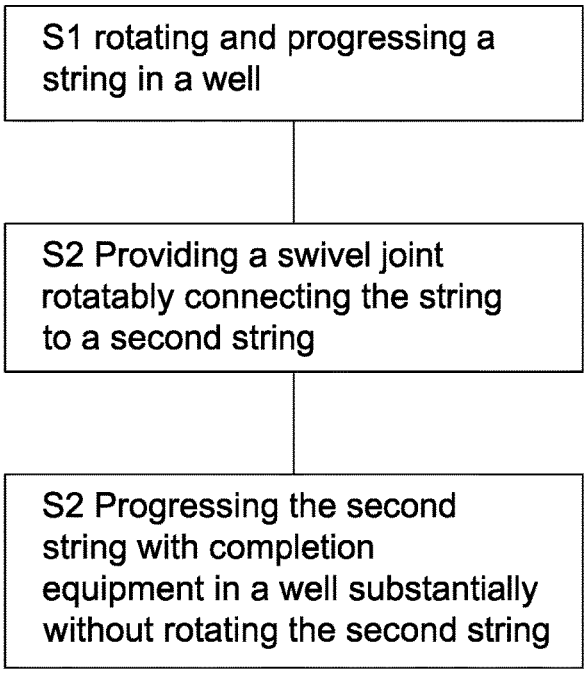
FIG. 4 is a flow diagram of a method.

FIG. 4 is a flow diagram of a method, comprising rotating and progressing a string in a well (S1), providing a swivel joint rotatably connecting the string to a second string (S2) and progressing the second string with completion equipment in a well substantially without rotating the second string (S3).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A method of completing a well which has a longitudinal axis along a direction with a horizontal component, the method comprising:

rotating a first string and a pusher sub at an end of the first string and moving the first string into the well along the longitudinal axis of the well, wherein the pusher sub comprises wheels, bringing the wheels into contact with a formation or casing at an angle between 0 and 20 degrees to a plane perpendicular to a longitudinal axis of the pusher sub so that said rotating of the first string causes the pusher sub and the first string to advance into the well, providing a swivel joint rotatably connecting the first string to a second string, moving the second string and an anti-rotation sub provided on the second string along the longitudinal axis of the well into the well, wherein the second string comprises completion equipment and the anti-rotation sub comprises wheels, bringing the wheels of the anti-rotation sub into contact with the formation or casing, wherein the wheels of the anti-rotation sub are aligned with a longitudinal direction of the second string to substantially prevent rotation of the second string, and moving the completion equipment into the well along the longitudinal axis of the well.

2. The method of claim 1, wherein the second string is rotationally at rest during said moving the second string.

3. The method of claim 1, wherein the swivel joint comprises a ball bearing.

4. The method of claim 1, wherein the swivel joint comprises a thrust washer.

5. The method of claim 1, wherein the wheels of the pusher sub are brought into contact with the formation or casing at an angle with respect to the plane perpendicular to the longitudinal axis of the sub between 0 and 10 degrees or between 0 and 5 degrees, or between 5 and 10 degrees.

6. The method of claim 1, wherein the wheels of the pusher sub are brought into contact with the formation or casing at an angle of substantially between 2 and 5 degrees with respect to the plane perpendicular to the longitudinal axis of the sub.

7. A well completion assembly comprising:

a first string arranged to rotatably progress through the well, a pusher sub at an end of the first string and comprising wheels arranged to be brought into contact with a formation or casing of the well at an angle with respect to a plane perpendicular to a longitudinal axis of the pusher sub between 0 and 20 degrees, so that rotation of the first string causes the pusher sub and the first string to advance into the well, a second string comprising a completion equipment, an anti-rotation sub provided on the second string and comprising retractable wheels arranged to be brought into contact with the formation or casing, wherein said wheels of the anti-rotation sub are configured to be aligned with a longitudinal direction of the second string such that the contact of the retractable wheels of the anti-rotation sub with the formation or casing substantially prevents rotation of the second string, and a swivel joint rotatably connected to the first string and the second string.

8. The well assembly of claim 7 wherein the swivel joint comprises a ball bearing.

9. The well assembly of claim 7, wherein the swivel joint comprises a thrust washer.

10. The well assembly of claim 7, wherein the wheels of the pusher sub are arranged to be brought into contact with the formation or casing at an angle with respect to the plane perpendicular to the longitudinal axis of the sub between 0 and 10 degrees or between 0 and 5 degrees, or between 5 and 10 degrees.

11. The well assembly of claim 7, wherein the wheels of the pusher sub are arranged to brought into contact with the formation or casing at an angle of substantially between 2 and 5 degrees with respect to the plane perpendicular to the longitudinal axis of the sub.

* * * * *